United States Patent [19]

Kueny

[11] Patent Number: 4,532,895

[45] Date of Patent: Aug. 6, 1985

[54] PRIMER FOLLOW-THROUGH SYSTEM

[75] Inventor: Don F. Kueny, Waukegan, Ill.

[73] Assignee: Outboard Marine Corporation, Waukegan, Ill.

[21] Appl. No.: 583,685

[22] Filed: Feb. 28, 1984

[51] Int. Cl.[3] ..... F02M 1/16

[52] U.S. Cl. ..... 123/187.5 R; 123/447

[58] Field of Search ..... 123/187.5 R, 187.5 P, 123/180 R, 180 P, 180 A, 447

[56] References Cited

U.S. PATENT DOCUMENTS

| | | | |
|---|---|---|---|
| 2,175,743 | 10/1939 | Coffman | 123/187.5 R |
| 2,458,999 | 1/1949 | Mills | 123/187.5 R |
| 2,744,512 | 5/1956 | Franck | 123/187.5 R |
| 4,373,479 | 2/1983 | Billingsley | 123/187.5 R |
| 4,381,750 | 5/1983 | Funada | 123/447 |

FOREIGN PATENT DOCUMENTS

| | | | |
|---|---|---|---|
| 552725 | 4/1943 | United Kingdom | 123/447 |

*Primary Examiner*—E. Rollins Cross

*Attorney, Agent, or Firm*—Michael, Best & Friedrich

[57] ABSTRACT

A fuel supply system for an internal combustion engine including a combustion chamber and a rotatably mounted crankshaft, the fuel supply system comprising means for priming the internal combustion engine by supplying priming fuel from a fuel source to the combustion chamber, the priming means including a fuel line communicating with the fuel source and with the combustion chamber, and including selectively operable means for causing fuel flow in the fuel line. The fuel supply system also comprises means connected to the fuel line for automatic accumulation of fuel during fuel flow through the fuel line to the combustion chamber, and for automatic delivery, after discontinuance of fuel flow in the fuel line, of the accumulated fuel into the fuel line.

15 Claims, 4 Drawing Figures

PRIMER FOLLOW-THROUGH SYSTEM

BACKGROUND OF THE INVENTION

The invention relates to systems for supplying fuel to an internal combustion engine, and more particularly to systems for supplying priming fuel to the combustion chamber of an internal combustion engine.

In some prior priming systems it is difficult to provide "follow-through," i.e., enrichment during warm-up of the engine.

Attention is directed to the following U.S. patents which disclose priming systems:

Billingsley U.S. Pat. No. 4,373,479 issued Feb. 15, 1983;

Morris U.S. Pat. No. 4,411,844 issued Oct. 25, 1983.

SUMMARY OF THE INVENTION

The invention provides a fuel supply system for an internal combustion engine including a combustion chamber and a rotatably mounted crankshaft, the fuel supply system comprising means for priming the internal combustion engine by supplying priming fuel from a fuel source to the combustion chamber, the priming means including a fuel line communicating with the fuel source and with the combustion chamber, and including selectively operable means for causing fuel flow in the fuel line. The fuel supply system also comprises means connected to the fuel line for automatic accumulation of fuel during fuel flow through the fuel line to the combustion chamber, and for automatic delivery, after discontinuance of fuel flow in the fuel line, of the accumulated fuel into the fuel line.

In one embodiment, the means for accumulation and delivery of fuel delivers the accumulated fuel into the fuel line at a decreasing rate of flow.

In one embodiment, the amount of fuel accumulated is proportional to the length of time of operation of the selectively operable means for causing fuel flow in the fuel line.

In one embodiment, the fuel accumulating means comprises a fuel reservoir and a fuel passage communicating between the fuel reservoir and the fuel line.

In one embodiment, the fuel accumulating means comprises a fuel reservoir having top and bottom ends and being positioned above the fuel line, the fuel reservoir including a vent opening in the top end of the fuel reservoir and a vertical fuel passage communicating between the bottom end of the fuel reservoir and the fuel line. The fuel accumulating means further comprises valve means controlling the vent opening, the valve means keeping the vent opening open unless the fuel reservoir is full of fuel, and the valve means closing the vent opening when the fuel reservoir is full of fuel.

In one embodiment, the fuel accumulating means further comprises means for controlling fuel flow through the fuel passage such that during operation of the selectively operable means for causing fuel flow in the fuel line, fuel flows into the fuel reservoir through the fuel passage from the fuel line, and such that after operation of the selectively operable means for causing fuel flow in the fuel line, fuel flows out of the fuel reservoir through the passage into the fuel line at a decreasing rate of flow.

In one embodiment, the means for controlling fuel flow out of the fuel reservoir through the fuel passage includes a restricted portion of the fuel passage.

In one embodiment, the means for controlling fuel flow out of the fuel reservoir through the fuel passage includes first and second passage portions of the fuel passage in parallel relation to each other and communicating with the fuel reservoir, and valve means for selectively controlling fuel flow through the first passage portion such that fuel flow to the fuel reservoir through the first passage portion is permitted, and such that fuel flow from the fuel reservoir through the first passage portion is prevented.

A principal feature of the invention is the follow-through of the fuel supply system after priming of the engine. The system provides automatic accumulation of fuel during priming, and automatic delivery, after priming, of the accumulated fuel to the engine.

Another principal feature of the invention is the accumulation of an amount of fuel that is proportional to the length of time of priming. This means that in cold weather, when more priming is used, more follow-through is provided.

Another principal feature of the invention is the automatic delivery of the accumulated fuel to the engine at a decreasing rate of flow. This matches the rate of fuel supplied to the engine's decreasing need as it warms up.

Other features and advantages of the embodiments of the invention will become apparent to those skilled in the art by reference to the following detailed description, claims and drawings.

Figure 1:
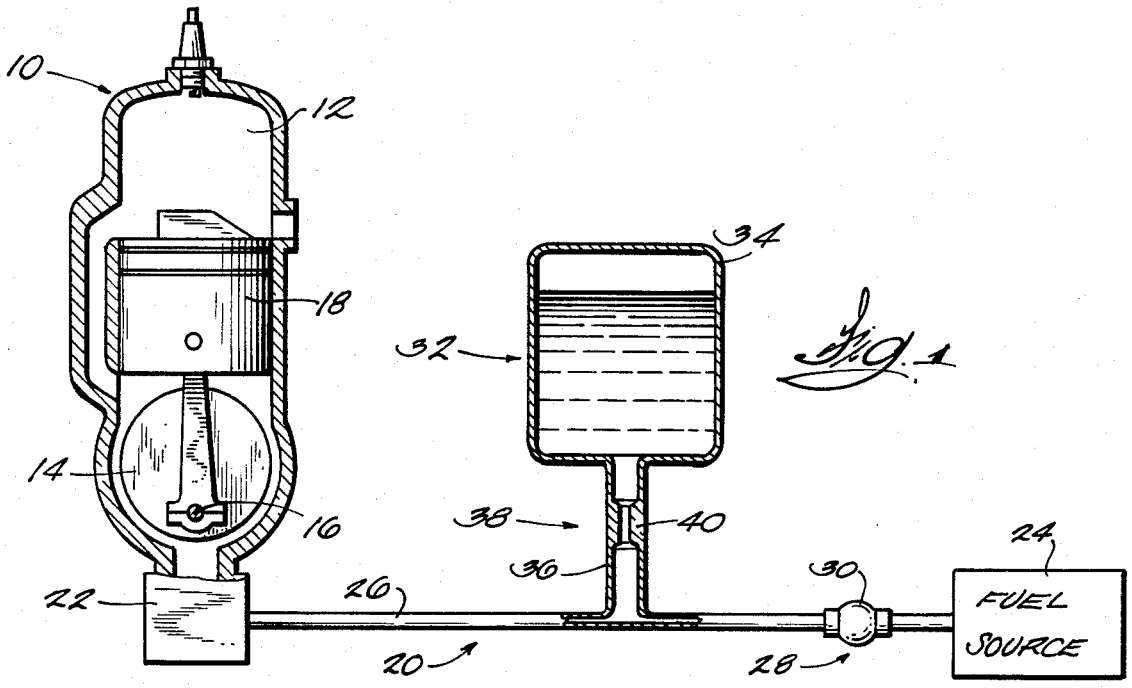
FIG. 1 is a schematic view of a fuel supply system including one embodiment of the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is an internal combustion engine 10 which includes a combustion chamber 12 and a crank case 14. The crank case 14 includes a rotatably mounted crank shaft 16 and experiences alternate conditions of relatively high pressure and low pressure in response to the reciprocation of a piston 18.

More particularly, the engine 10 includes a fuel supply system 20 operable to supply priming fuel to the engine combustion chamber 12. The fuel supply system 20 supplies fuel to a carburetor 22 which supplies fuel to the combustion chamber 12 of the engine 10 in response to the throttle setting and the rate of piston reciprocation, as is well known in the art. The carburetor 22 communicates with means for priming the engine by supplying priming fuel from a fuel source 24, the priming means including a fuel line 26 communicating with the fuel source 24 and with the carburetor 22, and including selectively operable means 28 for causing fuel flow in the fuel line 26. While in the illustrated construction the priming means communicates with the carburetor 22, it is to be understood that any suitable location for feeding the combustion chamber 12 could be employed.

While various suitable selectively operable means 28 for causing fuel flow in the fuel line 26 could be used, in the illustrated construction, the means is a manually operable primer bulb 30. Such primer bulbs 30 are well known in the art and will not be further described herein.

Connected to the fuel line 26 is means 32 for automatic accumulation of fuel during fuel flow through the fuel line 26 to the combustion chamber 12, and for automatic delivery, after discontinuance of fuel flow, of the accumulated fuel into the fuel line 26. It is to be understood that various means 32 could be employed for this purpose, and four alternative constructions are described in detail below.

In the construction illustrated in FIG. 1, the means 32 for automatic accumulation of fuel comprises a fuel reservoir 34 connected to the fuel line 26 by a fuel passage 36. The fuel reservoir 34 is sealed such that air and fuel can enter or exit the fuel reservoir only through the fuel passage 36. Although in FIG. 1 the fuel reservoir 34 is shown as being positioned above the fuel line 26, the fuel reservoir 34 could be positioned otherwise relative to the fuel line 26.

During priming, as fuel flows under pressure through the fuel line 26 toward the engine 10, fuel enters the fuel reservoir 34 through the fuel passage 36, entrapping air in the fuel reservoir 34. Fuel flows into the fuel reservoir 34 until the pressure of the entrapped air equals the fuel line pressure, or until priming is discontinued. When priming is discontinued, the fuel line pressure drops, and fuel is forced out of the fuel reservoir 34 until the pressure in the fuel reservoir 34 drops to pre-priming pressure. Thus, the fuel reservoir 34 automatically accumulates fuel during priming, and automatically delivers the accumulated fuel to the fuel line 26 after priming.

Because the selectively operable means 28 for causing fuel flow in the fuel line 26, in this case the primer bulb 30, includes a check valve preventing fuel flow back toward the fuel source 24, as is well known the primer art, the fuel forced out of the fuel reservoir 34 must flow to the engine carburetor 22.

In the preferred embodiment illustrated in FIG. 1, the fuel accumulating means 32 further comprises means 38 for controlling fuel flow through the fuel passage 36 such that during priming, fuel flows into the fuel reservoir 34 through the fuel passage 36 from the fuel line 26, and such that after priming, fuel flows out of fuel reservoir 34 through the fuel passage 36 into the fuel line 26 at a decreasing rate of flow. While this means 38 could have various suitable constructions, in the fuel supply sytem 20 illustrated in FIG. 1, this means 38 includes a restricted portion 40 of the fuel passage 36. The restriction in the fuel passage 36 limits the maximum flow rate of fuel through the fuel passage 36, thereby preventing the entire amount of fuel in the fuel reservoir 34 from flowing out of the fuel reservoir 34 in one brief gush. As the pressure drops in the fuel reservoir 34, the fuel flow rate out of the reservoir 34 decreases.

Figure 2:
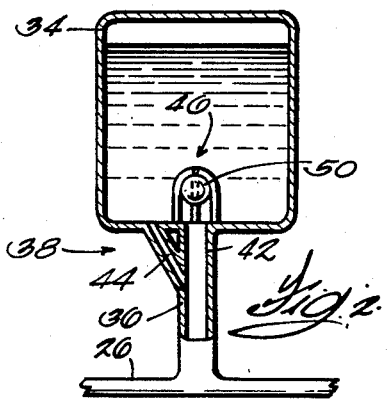
FIG. 2 is a schematic view of an alternative embodiment of the fuel accumulating means of the invention.

FIG. 2 shows an alternative embodiment of the means 38 for controlling fuel flow through the fuel passage 36. In the construction illustrated in FIG. 2, the means 38 includes a first portion 42 of the fuel passage 36 communicating with the fuel reservoir 34 and a second portion 44 of the fuel passage 36 in parallel relation to the first portion 42 and communicating with the fuel reservoir 34. The means 38 for controlling fuel flow through the fuel passage 36 further includes valve means 46 controlling fuel flow through the first passage portion 42 such that fuel flow to the fuel reservoir 34 through the first passage portion 42 is permitted, and such that fuel flow from the fuel reservoir 34 through the first passage portion 42 is prevented.

In this alternative construction, fuel flows freely into the fuel reservoir 34 through both of the first and second passage portions 42 and 44, but fuel flow out of the reservoir 34 is more controlled, since fuel flows out of the fuel reservoir 34 only through the second passage portion 44. In the preferred alternative embodiment illustrated in FIG. 2, the second passage portion 44 has a diameter which is substantially smaller than the diameter of the first passage portion 42. The effect of this restricted diameter is the same as the effect of the restricted passage portion 40 in the fuel passage 36 illustrated in FIG. 1.

While various suitable valve means 46 could be used to control fuel flow through the first passage portion 42, in the construction illustrated in FIG. 2, the valve means 46 comprises a conventional ball check valve 50.

Figure 3:
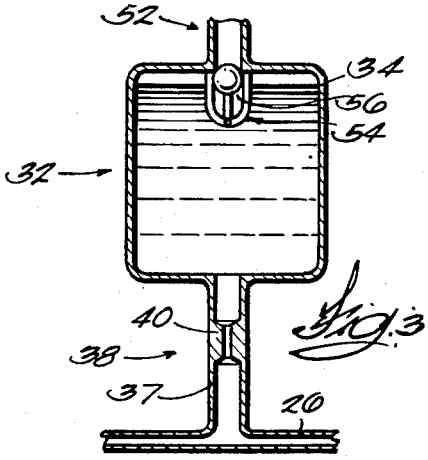
FIG. 3 is a schematic view of a second alternative embodiment of the fuel accumulating means of the invention.

Illustrated in FIG. 3 is a second alternative embodiment of the invention including an alternative construction of the fuel accumulating and delivery means 32. In the construction illustrated in FIG. 3, the fuel accumulating means 32 comprises a fuel reservoir 34 having top and bottom ends and being positioned above the fuel line 26, the fuel reservoir 34 including a vent opening 52 in its top end and valve means 54 controlling the vent opening 52, the valve means 54 keeping the vent opening 52 open unless the fuel reservoir 34 is full of fuel, and closing the vent opening 52 when the fuel reservoir 34 is full of fuel. The fuel accumulating means 32 further comprises a vertical fuel passage 37 communicating between the bottom end of the fuel reservoir 34 and the fuel line 26.

While in the construction illustrated in FIGS. 1 and 2 the positioning of the fuel reservoir 34 relative to the fuel line 26 was not of significance, in the construction illustrated in FIG. 3, the fuel reservoir 34 must be positioned above the fuel line 26. The reason for this difference is that in the alternative construction illustrated in FIG. 3, fuel delivery to the fuel line 26 is caused mainly by gravity, rather than by pressure in the fuel reservoir 34.

In a fuel supply system 20 including the alternative fuel accumulation and delivery means 32 of FIG. 3, fuel flows under pressure during priming through the fuel line 26 toward the engine 10. Because the fuel reservoir 34 is vented, the pressure in the fuel reservoir 34 is less than the fuel line pressure, and fuel flows upwardly through the vertical fuel passage 37 into the fuel reservoir 34. The valve means 54 keeps the fuel reservoir 34 from overflowing, because when the fuel reservoir 34 becomes full of fuel, the valve means 54 closes the vent opening 52. After the vent opening 52 is closed, the pressure in the fuel reservoir 34 increases until it equals the pressure in the fuel line 26, at which point fuel no longer flows upwardly into the fuel reservoir 34.

If priming is discontinued before the fuel reservoir 34 becomes full of fuel, the vent opening 52 remains open, and fuel flow into the fuel reservoir 34 ceases due to a drop of pressure in the fuel line 26. Pressure does not build up in the fuel reservoir 34, and all fuel flow out of the fuel reservoir 34 is caused only by gravity.

If priming is not discontinued before the fuel reservoir 34 fills with fuel, the initial flow of fuel out of the fuel reservoir 34 after priming is caused by pressure in the fuel reservoir 34 in a way similar to the way in which fuel flow is caused out of the fuel reservoir 34 of FIG. 1. However, in the fuel reservoir 34 of FIG. 3, once fuel flow out of the fuel reservoir 34 begins, so that the fuel reservoir 34 is no longer full of fuel, the valve means 54 opens the vent opening 52, and the pressure in the fuel reservoir 34 becomes equal to the pressure in the fuel line 26. After this occurs, fuel flow through the vertical fuel passage 37 is caused only by gravity.

While various suitable valve means 54 could be employed for controlling the vent opening 52, in the illustrated construction, the valve means is a ball float valve 56.

In the preferred alternative embodiment illustrated in FIG. 3, the fuel accumulating means 32 further comprises means 38 for controlling fuel flow downwardly through the vertical fuel passage 37 such that during priming, fuel flows upwardly into the fuel reservoir 34, and such that after priming, fuel flows downwardly out of the fuel reservoir 34 at a decreasing rate of flow. In the alternative construction illustrated in FIG. 3, this means 38 for controlling fuel flow through the vertical passage 37 includes a restricted portion 40 of the vertical fuel passage 37. This restricted portion 40 serves the same function as does the restricted portion 40 in the fuel passage 36 illustrated in FIG. 1.

Figure 4:
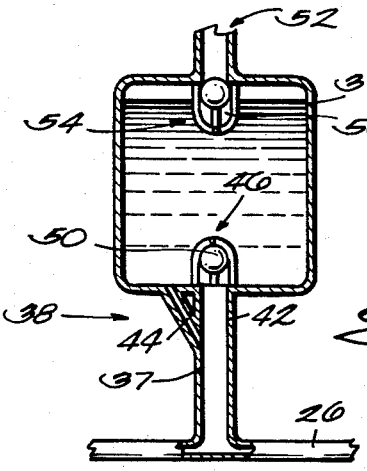
FIG. 4 is a schematic view of a third alternative embodiment of the fuel accumulating means of the invention.

Again, it should be understood that other suitable means 38 could be used for controlling fuel flow through the vertical fuel passage 37, and illustrated in FIG. 4 is the fuel accumulating means 32 of FIG. 3 including one possible alternative construction of the means 38 for controlling fuel flow through the vertical fuel passage 37.

In the alternative construction illustrated in FIG. 4, this means 38 includes first and second passage portions 42 and 44 of the vertical fuel passage 37 in parallel relation to each other and communicating with the bottom end of the fuel reservoir 34. Further included is valve means 46 controlling fuel flow through the first passage portion 42 such that fuel flow to the fuel reservoir 34 through the first passage portion 42 is permitted, and such that fuel flow from the fuel reservoir 34 through the first passage portion 42 is prevented. This means 38 for controlling fuel flow through the vertical fuel passage 37 is identical to the means 38 illustrated in FIG. 2. The second passage portion 44 of the vertical fuel passage 37 has a diameter which is substantially smaller than the diameter of the first passage portion 42, and the valve means 46 for controlling fuel flow through the first passage portion 42 comprises a ball check valve 50.

Various of the features of the invention are set forth in the following claims.

I claim:

1. A fuel supply system for an internal combustion engine including a combustion chamber, said fuel supply system comprising means for priming said internal combustion engine by supplying priming fuel from a fuel source to the combustion chamber, said priming means including a fuel line communicating with the fuel source and with the combustion chamber, and including selectively operable means for causing fuel flow in said fuel line, and means connected to said fuel line for automatic accumulation of fuel during fuel flow through said fuel line to the combustion chamber, and for automatic delivery, after discontinuance of fuel flow in said fuel line, of the accumulated fuel into said fuel line, said means connected to said fuel line comprising a fuel passage communicating with said fuel line, and a fuel reservoir which is permanently closed from the atmosphere and which solely communicates with said fuel passage.

2. A fuel supply system in accordance with claim 1 wherein said means for accumulation and delivery of fuel delivers the accumulated fuel into said fuel line at a decreasing rate of flow.

3. A fuel supply system in accordance with claim 1 wherein the amount of fuel accumulated is proportional to the length of time of operation of said selectively operable means for causing fuel flow in said fuel line.

4. A fuel supply system in accordance with claim 1 wherein said means for accumulation and delivery of fuel further comprises means for controlling fuel flow through said fuel passage such that during operation of said selectively operable means for causing fuel flow in said fuel line, fuel flows into said fuel reservoir through said fuel passage from said fuel line, and such that after operation of said selectively operable means for causing fuel flow in said fuel line, fuel flows out of said fuel reservoir through said fuel passage into said fuel line at a decreasing rate of flow.

5. A fuel supply system in accordance with claim 4 wherein said means for controlling fuel flow through said fuel passage includes a restricted portion of said fuel passage.

6. A fuel supply system for an internal combustion engine including a combustion chamber, said fuel supply system comprising means for priming said internal combustion engine by supplying priming fuel from a fuel source to the combustion chamber, said priming means including a fuel line communicating with the fuel source and with the combustion chamber, and including selectively operable means for causing fuel flow in said fuel line, a fuel reservoir, a fuel passage communicating between said fuel reservoir and said fuel line, and means for controlling fuel flow through said fuel passage such that during operation of said selectively operable means for causing fuel flow in said fuel line, fuel flows automatically through said fuel passage from said fuel line and accumulates in said reservoir, and such that after operation of said selectively operable means for causing fuel flow in said fuel line, fuel automatically flows out of said fuel reservoir through said fuel passage into said fuel line at a decreasing rate of flow, said means for controlling fuel flow through said fuel passage including a first portion of said fuel passage communicating with said fuel reservoir, a second portion of said fuel passage in parallel relation to said first portion and communicating with said fuel reservoir, and valve means for selectively controlling fuel flow through said first passage portion such that fuel flow to said fuel reservoir through said first passage portion is permitted, and such that fuel flow from said fuel reservoir through said first passage portion is prevented.

7. A fuel supply system in accordance with claim 6 wherein said first and second passage portions have diameters, and wherein said second passage portion has a diameter which is substantially smaller than the diameter of said first passage portion.

8. A fuel supply system in accordance with claim 6 wherein said valve means comprises a ball check valve.

9. A fuel supply system for an internal combustion engine including a combustion chamber, said fuel supply system comprising means for priming said internal combustion engine by supplying priming fuel from a fuel source to the combustion chamber, said priming means including a fuel line communicating with the fuel source and with the combustion chamber, and including selectively operable means for causing fuel flow in said fuel line, and means connected to said fuel line for automatic accumulation of fuel during fuel flow through said fuel line to the combustion chamber, and for automatic delivery, after discontinuance of fuel flow in said fuel line, of the accumulated fuel into said fuel line, said fuel accumulation and delivery means comprising a fuel reservoir having top and bottom ends and being positioned above said fuel line, said fuel reservoir including a vent opening in said top end of said fuel reservoir, a vertical fuel passage communicating between said bottom end of said fuel reservoir and said fuel line, and valve means for controlling airflow through said vent opening and being operable from an open position to a closed position in response to accumulation of fuel in said reservoir to a predetermined amount.

10. A fuel supply system in accordance with claim 9 wherein said valve means controlling said vent opening is a ball float valve.

11. A fuel supply system in accordance with claim 9 wherein said means for accumulation and delivery of fuel further comprises means for controlling fuel flow through said fuel passage such that during operation of said selectively operable means for causing fuel flow in said fuel line, fuel flows into said fuel reservoir through said fuel passage from said fuel line, and such that after operation of said selectively operable means for causing fuel flow in said fuel line, fuel flows out of said fuel reservoir through said fuel passage into said fuel line at a decreasing rate of flow.

12. A fuel supply system in accordance with claim 11 wherein said means for controlling fuel flow downwardly through said vertical fuel passage includes a restricted portion of said vertical fuel passage.

13. A fuel supply system for an internal combustion engine including a combustion chamber, said fuel supply system comprising means for priming said internal combustion engine by supplying priming fuel from a fuel source to the combustion chamber, said priming means including a fuel line communicating with the fuel source and with the combustion chamber, and including selectively operable means for causing fuel flow in said fuel line, and means connected to said fuel line for automatic accumulation of fuel during fuel flow through said fuel line to the combustion chamber, and for automatic delivery, after discontinuance of fuel flow in said fuel line, of the accumulated fuel into said fuel line, said fuel accumulation and delivery means comprising a fuel reservoir having top and bottom ends and being positioned above said fuel line, said fuel reservoir including a vent opening in said top end of said fuel reservoir, a vertical fuel passage communicating between said bottom end of said fuel reservoir and said fuel line, and valve means for controlling airflow through said vent opening and being operable from an open position to a closed position in response to accumulation of fuel in said reservoir to a predetermined amount, said fuel accumulation and delivery means further comprising means for controlling fuel flow downwardly through said vertical fuel passage such that during operation of said selectively operable means for causing fuel flow in said fuel line, fuel flows upwardly into said fuel reservoir through said vertical fuel passage from said fuel line, and such that after operation of said selectively operable means for causing fuel flow in said fuel line, fuel flows downwardly out of said fuel reservoir through said vertical fuel passage into said fuel line at a decreasing rate of flow, said means for controlling fuel flow downwardly through said vertical fuel passage including first and second passage portions of said vertical fuel passage in parallel relation to each other and communicating with said bottom end of said fuel reservoir, and valve means for controlling fuel flow through said first passage portion such that fuel flow upwardly to said fuel reservoir through said first passage portion is permitted, and such that fuel flow downwardly from said fuel reservoir through said first passage portion is prevented.

14. A fuel supply system in accordance with claim 13 wherein said first and second passage portions have diameters, and wherein the diameter of said second passage portion is substantially smaller than the diameter of said first passage portion.

15. A fuel supply system in accordance with claim 13 wherein said valve means comprises a ball check valve.

* * * * *